US010745917B2

(12) United States Patent
Ndobo-Epoy et al.

(10) Patent No.: US 10,745,917 B2
(45) Date of Patent: Aug. 18, 2020

(54) SYSTEM, METHOD AND APPARATUS FOR THERMAL BRIDGE-FREE INSULATION ASSEMBLY

(71) Applicant: CertainTeed Corporation, Malvern, PA (US)

(72) Inventors: Jean-Philippe Ndobo-Epoy, Westboro, MA (US); Todd P. DiNoia, Littleton, MA (US); Andrew Clyde Brandt, Pottstown, PA (US); Luc Pierre Vitry, Philadelphia, PA (US); Valerio Massara, Redavalle (IT); Conor Patrick McDonald, Boston, MA (US); Kenneth D Forsythe, Lititz, PA (US); Eric Nilsson, Exton, PA (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

(21) Appl. No.: 15/384,851

(22) Filed: Dec. 20, 2016

(65) Prior Publication Data

US 2017/0183875 A1 Jun. 29, 2017

Related U.S. Application Data

(60) Provisional application No. 62/387,130, filed on Dec. 23, 2015.

(51) Int. Cl.
*E04D 13/16* (2006.01)

(52) U.S. Cl.
CPC ..... *E04D 13/1637* (2013.01)

(58) Field of Classification Search
CPC . E04D 13/1618; E04D 13/16; E04D 13/1625; E04D 13/1637; E04D 13/1612; E04D 13/1606; E04D 12/002; E04D 3/3602; E04D 3/3603; E04D 3/3601; E04B 1/7654; E04B 1/7658; E04B 1/7629; E04B 1/7633; E04B 1/767; E04B 1/7666;
(Continued)

(56) References Cited

U.S. PATENT DOCUMENTS 1,870,838 A 8/1932 Davis
2,172,270 A 9/1939 Ansel
(Continued)

FOREIGN PATENT DOCUMENTS

AU 2010202733 A1 1/2011
CN 204645501 U 9/2015
(Continued)

OTHER PUBLICATIONS

International Search Report & Written Opinion for PCT/US2017/053963, dated Jan. 9, 2018, 15 pages.
(Continued)

*Primary Examiner* — Jessica L Laux
(74) *Attorney, Agent, or Firm* — Abel Schillinger, LLP; Thomas H. Osborn

(57) ABSTRACT

A thermal bridge-free insulation assembly may include hangers to support insulation in an attic. The hanger may include an axis, a proximal end coupled to a rafter, and a distal end coupled to a barrier. The hanger also may include at least two components that are axially movable relative to each other to selectively adjust a depth of an insulation space.

10 Claims, 7 Drawing Sheets

(58) Field of Classification Search
CPC ..... E04B 1/7625; E04B 1/62; E04F 13/0801; E04F 13/0807; E04F 13/0853; E04F 13/0805; E04F 13/0803
USPC ..... 52/506.01, 506.06, 512, 407.4, 407.5, 52/404.2, 404.5, 220.6
See application file for complete search history.

(56) References Cited

U.S. PATENT DOCUMENTS 2,793,887 A 5/1957 Moore
3,321,878 A 5/1967 Brown et al.
D210,872 S 4/1968 Marsh
3,732,659 A * 5/1973 LaBarge ..... E04B 1/6803 52/461
3,738,217 A 6/1973 Walker
4,047,346 A 9/1977 Alderman
4,155,206 A * 5/1979 Player ..... E04D 3/30 52/200
4,231,280 A 11/1980 Gross
4,292,777 A 10/1981 Story
4,320,605 A 3/1982 Carlson et al.
D267,776 S 2/1983 Holgersson et al.
4,425,747 A * 1/1984 Player ..... E04B 9/26 52/404.3
4,437,282 A 3/1984 O'Brien
4,476,659 A * 10/1984 Player ..... E04D 3/30 52/404.1
4,573,298 A 3/1986 Harkins
4,592,688 A 6/1986 Kramer
4,597,702 A 7/1986 Brown
4,635,423 A 1/1987 Ward
4,724,651 A 2/1988 Fligg
4,856,247 A 8/1989 Georgino
4,875,320 A 10/1989 Sparkes
4,930,285 A 6/1990 Ward
5,085,023 A 2/1992 Duffy
5,442,890 A * 8/1995 Fligg ..... E04B 9/22 52/404.3
5,581,966 A * 12/1996 Fligg ..... E04B 9/22 160/392
5,636,487 A * 6/1997 Fligg ..... E04B 9/22 52/404.3
5,704,170 A 1/1998 Simpson
6,006,481 A 12/1999 Jacobs
D419,693 S 1/2000 Hersh et al.
D420,149 S 2/2000 Hersh et al.
D443,198 S 6/2001 Snyder
D446,442 S 8/2001 Simpson
D452,424 S 12/2001 Simpson, Sr.
6,324,808 B1 12/2001 Lippy et al.
D462,601 S 9/2002 Chaney
6,487,825 B1 12/2002 Sillik
6,808,772 B2 10/2004 Kunzel et al.
6,890,666 B2 5/2005 Kunzel et al.
7,008,890 B1 3/2006 Kunzel et al.
7,017,315 B2 3/2006 Corwin
7,021,016 B2 4/2006 Steffes et al.
D523,968 S 6/2006 Gilbert
7,090,174 B2 8/2006 Korczak et al.
D599,193 S 9/2009 Meyer et al.
D607,711 S 1/2010 Adams et al.
D616,035 S 5/2010 Kosir et al.
7,908,813 B2 3/2011 Gulbrandsen et al.
7,921,619 B2 4/2011 Snyder et al.
7,997,180 B2 8/2011 Söderberg
8,132,379 B2 3/2012 Zaveri et al.
8,281,548 B1 10/2012 Garcia
D684,844 S 6/2013 Ferreira
8,613,180 B2 12/2013 Strickland et al.
8,635,824 B2 1/2014 Scherrer
8,640,429 B1 2/2014 Watts et al.
8,657,244 B2 2/2014 Sillik
D701,329 S 3/2014 Tiner et al.
8,739,486 B2 6/2014 Bodsford et al.
D724,259 S 3/2015 Klus
8,985,927 B2 3/2015 Ashton et al.
9,032,678 B2 5/2015 Shaw et al.
D732,912 S 6/2015 Cavaliere et al.
D737,120 S 8/2015 Recker et al.
D739,709 S 9/2015 Wright
9,255,406 B1 2/2016 McCary, Sr.
D754,405 S 4/2016 Herde
9,322,179 B2 4/2016 Oberg
9,359,471 B2 6/2016 Trumbo et al.
9,366,052 B1 6/2016 Warner et al.
9,476,204 B2 10/2016 Wolf
9,546,480 B2 1/2017 Jakobsen et al.
D787,092 S 5/2017 Singh
D789,559 S 6/2017 Singh
D790,078 S 6/2017 Singh
D790,732 S 6/2017 Singh
D790,734 S 6/2017 Singh
D790,735 S 6/2017 Singh
9,671,046 B2 6/2017 Whipple et al.
D791,350 S 7/2017 Singh
D791,351 S 7/2017 Singh
D791,355 S 7/2017 Singh
D791,359 S 7/2017 Singh
D791,360 S 7/2017 Singh
D791,361 S 7/2017 Singh
D793,848 S 8/2017 Charette
D811,853 S 3/2018 Foley et al.
9,920,516 B2 3/2018 Alter et al.
D837,038 S 1/2019 Ndobo-Epoy et al.
2004/0216408 A1 11/2004 Hohmann, Jr.
2005/0017142 A1* 1/2005 Ogden ..... E04D 13/1625 248/247
2006/0078753 A1 4/2006 Bomberg et al.
2007/0015424 A1 1/2007 Toas et al.
2008/0115460 A1 5/2008 Ruid et al.
2008/0237433 A1 10/2008 Hardin
2010/0043328 A1 2/2010 Kallweit
2011/0016816 A1 1/2011 Lizarazu
2011/0256786 A1 10/2011 Bomberg
2011/0271626 A1 11/2011 Lewis
2013/0280467 A1 10/2013 Fay
2015/0176211 A1 6/2015 Knapp et al.
2015/0218802 A1 8/2015 Wolf
2015/0218803 A1 8/2015 Rockwell et al.
2015/0233110 A1 8/2015 Alter et al.
2015/0240477 A1 8/2015 Weeks et al.
2015/0300003 A1 10/2015 Jakobsen et al.
2016/0319537 A1 11/2016 Rinne et al.
2017/0282510 A1 10/2017 Peet et al.
2017/0313630 A1 11/2017 Peet et al.
2018/0094427 A1 4/2018 Ndobo-Epoy et al.

FOREIGN PATENT DOCUMENTS

EP 0319390 A1 6/1989
FR 3026762 A1 4/2016
GB 1590450 A 6/1981
GB 2491933 A 12/2012
KR 101523898 B1 6/2015
WO 2013079076 A1 6/2013
WO 2015095786 A1 6/2015
WO 2015117154 A1 8/2015
WO 2018064305 A1 4/2018

OTHER PUBLICATIONS

Babineau, Jr., Francis, "Cost-Effective High-Performance Unvented Attics," Thermal Performance of the Exterior Envelopes of Whole Buildings XIII International Conference, 2016, pp. 34-45, Ashrae.
"L'étanchéitéà l'air Autrement—Présentation et mise en œuvre," Système RT Plus, Jan. 2016, 9 pages, Knauf Insulation.
"SOFTR® Duct Wrap FRK Product Data Sheet," Sep. 2010, 4 pages, Owens Corning, US.
Carpino, Elaina et al., "Delivering Energy Efficiency to the Top of the House," High Performance Conditioned Attic System, Owens Corning, dated Mar. 10, 2015, pp. 1-26.

(56) References Cited

OTHER PUBLICATIONS 2.000 IN Barbed U-Channel, posted at web.archive.org, posting date Sep. 22, 2013, accessed Jun. 28, 2018. url: https://web.archive.org/web/20130922053547/http://seagateplastics.com:80/Stock_Plastics_Catalog/catalog/plastic_c_channels.html, 2013.

Aluminum Recessed U-Channel for 10mm Glass Shower Screens, posted at wholesaleglasscompany.co.uk, accessed Jun. 27, 2018. url: https://www.wholesaleglasscompany.co.uk/acatalog/Aluminum-Recessed-U-Channel-for-10mm-Glass-Shower-Screens.html, 2018.

Aluminum U channel profile, posted at alcaglas.com, accessed Jun. 27, 2018, url: http://www.alcaglas.com/gb/producto.php?codigo=perid-u-aluminiov02820, 2018.

Insert Channel, posted at schematech.co.za, accessed Jun. 27, 2018, url: http://www.schematech.co.za/showers/metal-profiles/u-channel/insert-channel-8mm-1000mm.html, 2018.

Plastic Upholstery J-Clips, posted at trimlok.com, accessed Jun. 27, 2018, url: https://www.trimlok.com/plastic-extrusion/upholstery-clips, 2018.

12 Gauge Self Adhesive Stick Insulation Hanger, posted at alibaba.com, accessed Jul. 18, 2018, url: https://www.alibaba.com/product-detail/12-gauge-self-adhesive-stick-insulation_60573332407.html, 2018.

62mm Self Adhesive Insulation Hanger, posted at tdsupplies.co.uk, accessed Jul. 18, 2018, url: http://www.tdsupplies.co.uk/stick-pins, 2018.

Cup Head Pin and Paper Washer, posted at soundacousticsolutions.com, accessed Jul. 18, 2018, url: https://www.soundacousticsolutions.com/products/cup-head-pins-paper-washer-6855, 2018.

Duro Dyne Dynastick Self Adhesive Insulation Hangers, posted at amazon.com, accessed Jul. 18, 2018, url: https://www.amazon.com/Duro-Dyne-Dynastick-Insulation-SAH114/dp/B00DODP122, published Jun. 27, 2018.

Perforated Base Insulation Hanger, posted at techlite.com, accessed Jul. 18, 2018, url: https://www.techlite.com/techlite-acoustics/perforated-base-insulation-hanger, 2018.

* cited by examiner

SYSTEM, METHOD AND APPARATUS FOR THERMAL BRIDGE-FREE INSULATION ASSEMBLY

CROSS-REFERENCE TO RELATED APPLICATION(S)

This application claims priority under 35 U.S.C. § 119(e) to U.S. Patent Application No. 62/387,130, entitled "SYSTEM, METHOD AND APPARATUS FOR THERMAL BRIDGE-FREE INSULATION ASSEMBLY," by Jean-Philippe Ndobo-Epoy, et al., filed Dec. 23, 2015, which is assigned to the current assignee hereof and incorporated herein by reference in its entirety.

BACKGROUND OF THE INVENTION

Field of the Disclosure

The present invention relates in general to insulation and, in particular, to a system, method and apparatus for thermal bridge-free insulation assembly.

Description of the Related Art

In the southern U.S., the heating, ventilating and air conditioning (HVAC) ducts are traditionally installed in the attics of homes because of the lack of space in the house. There is often no basement because of regular floods (southeast) or for safety reasons against earthquakes (southwest). Most HVAC ducts are partially leaky, and a lot of energy is lost if they are placed above the insulation in the attics. It is well-known for years that the HVAC ducts should be part of the conditioned space.

Homes with insulation between attic roof rafters provide the best configuration for the HVAC in the attics, but most roof rafters are 2×4 inches or 2×6 inches, which are too small to reach the R-values (e.g., R30 to R49) required by building codes with traditional insulation, such as fiberglass or cellulose. A simple solution is thus required to insulate both between and below the rafters. Moreover, such designs lead to a higher risk regarding moisture management, if the tiles are not ventilated. In the U.S., ventilation typically is only in Zones 1-3 with clay tiles.

Some basic solutions have been used by roofing contractors for decades, such as adding wood lumber (e.g., 2×6 inches or 2×8 inches) to roof rafters, or attaching wood I-joists of the desired length. However, these solutions increase the weight of the roof, are time consuming to install, and present residual thermal bridges since they are wood and provide no continuous layer of insulation.

Another solution is disclosed in WO 2015/117154, which uses a fabric for a blown-in blanket system (BIBS). However, this system is quite time consuming to install since the airtightness must be ensured on the roof rafters and trusses. In addition, the BIBS membrane must be correctly folded and stapled before blowing the insulation. If the rafters are not perfectly aligned, a manual adjustment of the folding of the fabric with a ruler is necessary, which is even more time consuming. Moreover, there is no possibility to attach any load to this system, such as gypsum boards to form a finished ceiling for a room in the attic.

Solutions exist to address some of these issues, such as the Suspente Integra2 system from Saint-Gobain Isover France. See U.S. Pub. No. 2011/0016816, which is incorporated herein by reference in its entirety. That solution attaches a second layer of insulation below the rafters to enhance airtightness and moisture management. This is achieved by clipping a smart vapor retarder membrane behind gypsum boards, while maintaining a space for cables and the like, with metallic rails that retain the gypsum boards. Nevertheless, this metallic solution is not adapted to the U.S. market, which uses only wooden studs and rafters, not metal rails like commercial buildings. Thus, improvements in insulation systems continue to be of interest.

SUMMARY

Embodiments of a system, method and apparatus for thermal bridge-free insulation assemblies are disclosed. In one example, a hanger is used to support insulation in an attic having a roof deck. The hanger may include a hanger body having a shaft with an axis, a proximal end configured to be coupled to the rafter, and a distal end configured to be coupled to a barrier. The hanger body also may include at least two components that are configured to be axially movable relative to each other and assembled together to form the hanger body. An insulation space may be defined between the proximal and distal ends of the hanger body inside the barrier.

In another embodiment, an attic insulation system for a home having a roof with a roof deck, an attic beneath the roof deck, rafters supporting the roof deck inside the attic, and exterior roofing products mounted to the roof deck opposite the rafters is disclosed. The attic insulation system may include a barrier, and hangers for supporting insulation in the attic. Each of the hangers may include a hanger body having a shaft with a proximal end coupled to one of the rafters, and a distal end coupled to the barrier. A metal plate may be located inside at least one of the proximal end or the distal end. An insulation space may be defined between the proximal and distal ends inside the barrier, and the insulation space may at least partially contain the insulation.

An alternate embodiment for an attic insulation system for a home having an attic with a deck, and beams fastened to the deck also is disclosed. The attic insulation system may include a barrier, and supports for providing an insulation space in the attic. Each of the supports may include a support body having a shaft with a proximal end coupled to one of the beams, and a distal end coupled to the barrier. The support body may include at least two components that are configured to be axially movable relative to each other and assembled together to form the support body. An insulation space may be defined between the proximal and distal ends of the support body inside the barrier. The insulation space may at least partially contain the insulation.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1A:
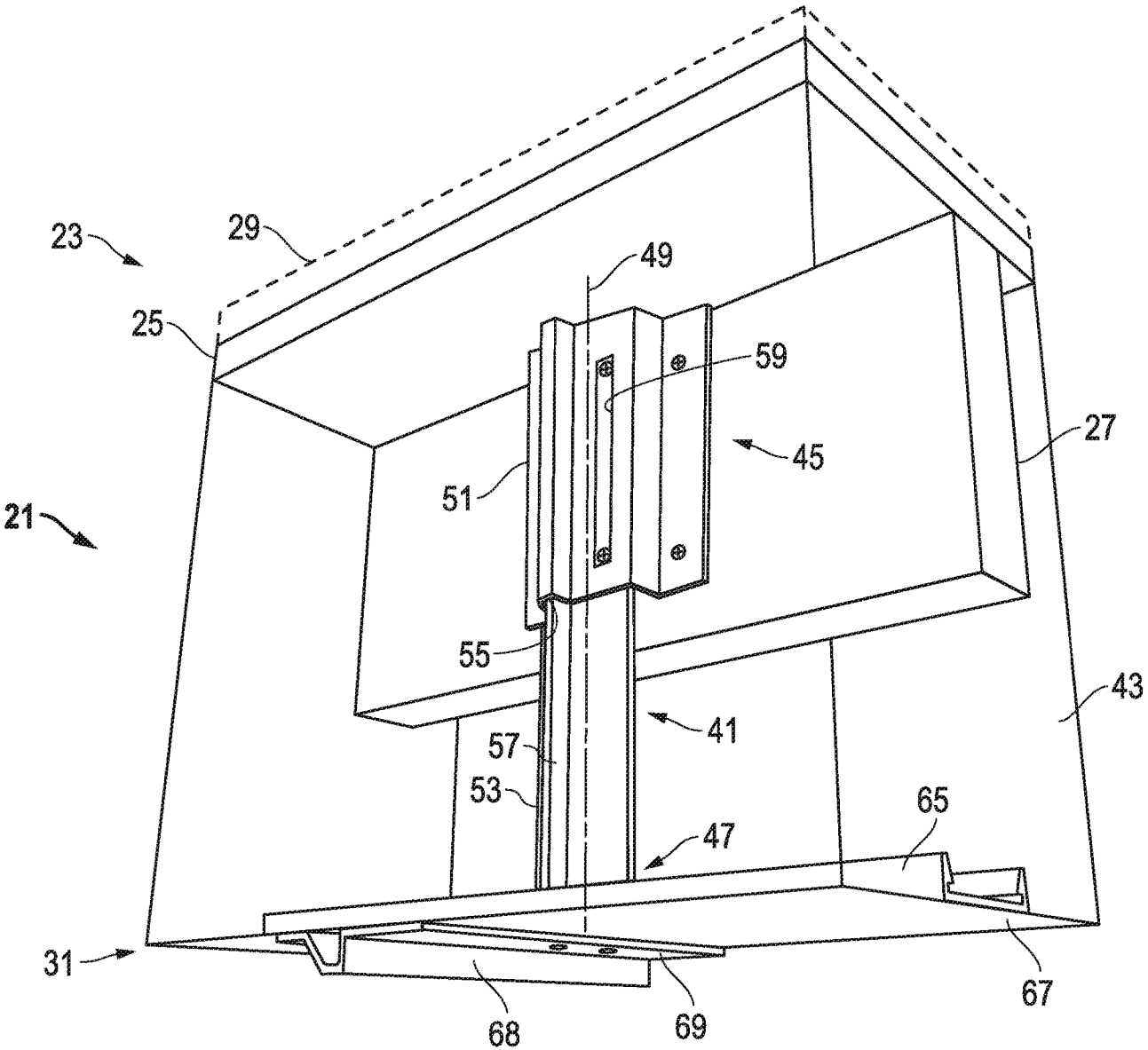
FIGS. 1A and 1B are isometric and side view of embodiments of an attic insulation system.
Figure 1B:
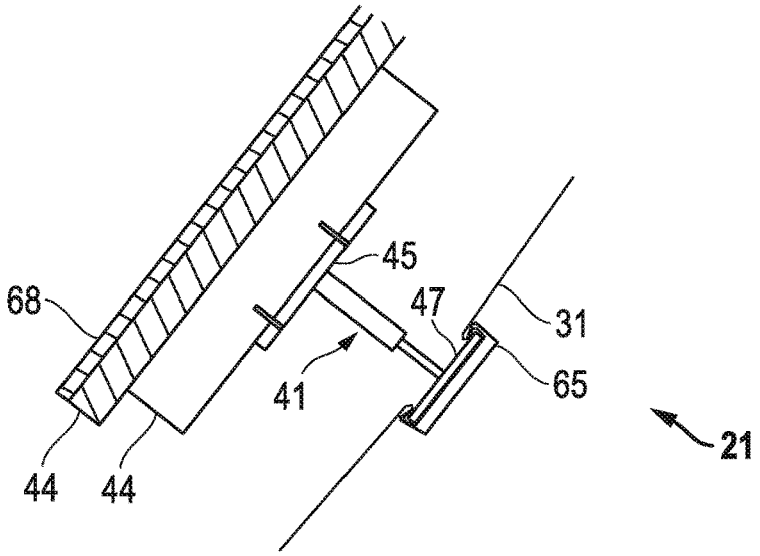

Embodiments of a system, method and apparatus for insulating an attic are disclosed. For example, FIG. 1 depicts an attic insulation system 21 for a home having a roof 23 with a roof deck 25. The attic of the home is located beneath the roof deck 25. Rafters 27 support the roof deck 25 inside the attic. Exterior roofing products 29 may be mounted to the roof deck 25 opposite the rafters 27.

In some versions, the attic insulation system 21 may include one or more barriers 31. In addition, hangers 41 may be used for supporting insulation 43 in the attic. Embodiments of the hangers 41 may include a hanger body having a shaft with a proximal end 45 coupled to one of the rafters 27, and a distal end 47 coupled to the barrier 31. An insulation space is defined between the proximal and distal ends 45, 47 inside the barrier 31. The insulation space may at least partially contain the insulation 43.

Embodiments of the barrier 31 may include at least one of a stud, batten, strapping, gypsum board or membrane. The barrier 31 may be formed from wood or plastic, in some examples. The barrier 31 also may include at least one of open glass mesh, vapor closed polyethylene or smart vapor retarder (SVR). The barrier 31 can support blown insulation comprising at least one of fiberglass, stonewool or cellulose. In addition, the barrier 31 may be reinforced with a glass net that supports a pressure of blown insulation. In still other versions, the barrier 31 may include gypsum boards mounted to the distal ends 47 of the hangers 41. In one example, the SVR may be mounted to the gypsum board.

Embodiments of the hanger 41 may include an axis 49, and at least two components 51, 53 that are assembled together to form the hanger body. In some versions, the at least two components 51, 53 are axially movable relative to each other. The first component 51 may be mounted to the rafter 27, and the second component 53 may be engaged with the first component 51. The second component 53 may be adjustable relative to the first component 51 to modify an axial length of the hanger 41. In some versions, the first component 51 may comprise a bracket screwed to a side of the rafter 27 that is substantially perpendicular to the roof deck 25. The second component 53 may comprise a strut that is substantially rectangular and elongated. The strut or second component 53 may slidably engage the bracket or first component 51.

In other examples, the hanger 41 may comprise plastic, such as an acrylic like polymethyl methacrylate (PMMA), which may be reinforced with glass fibers. In some versions, the hanger 41 itself is not metallic. In other versions, only a portion of hanger 41 is metallic so as to not form a thermal bridge. An example of the hanger 41 may be designed to be not deformable.

In some versions, the bracket or first component 51 may include a groove 55. The strut or second component 53 may include a rib 57 that seats in and slides in the groove 55. In addition, the bracket or first component 51 may include a slot 59. The strut or second component 53 may be fastened directly to the rafter 27 through the slot 59 in the bracket or first component 51.

Figure 11:
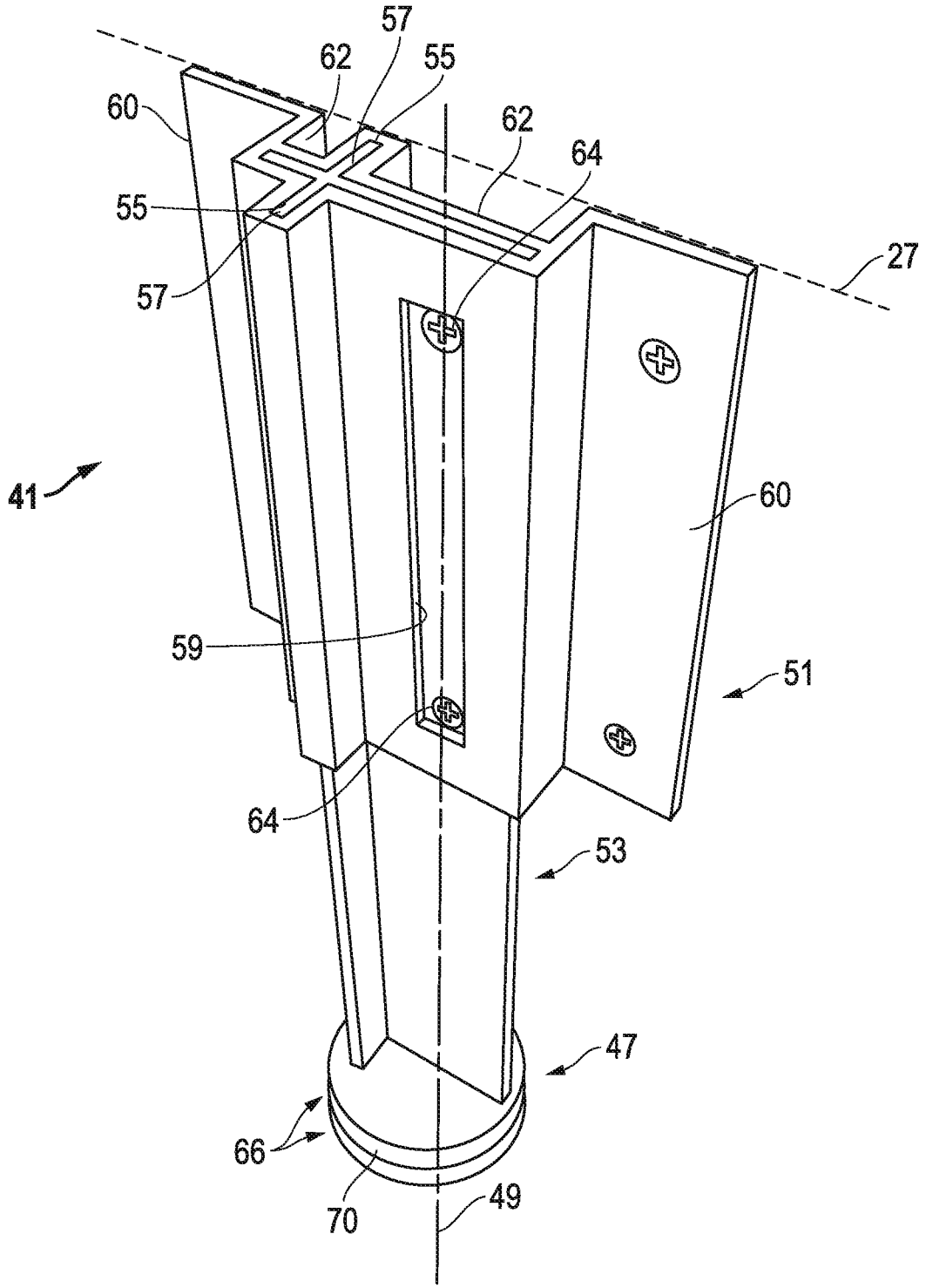
FIG. 11 is a top isometric view of another embodiment of a hanger.
Figure 12:
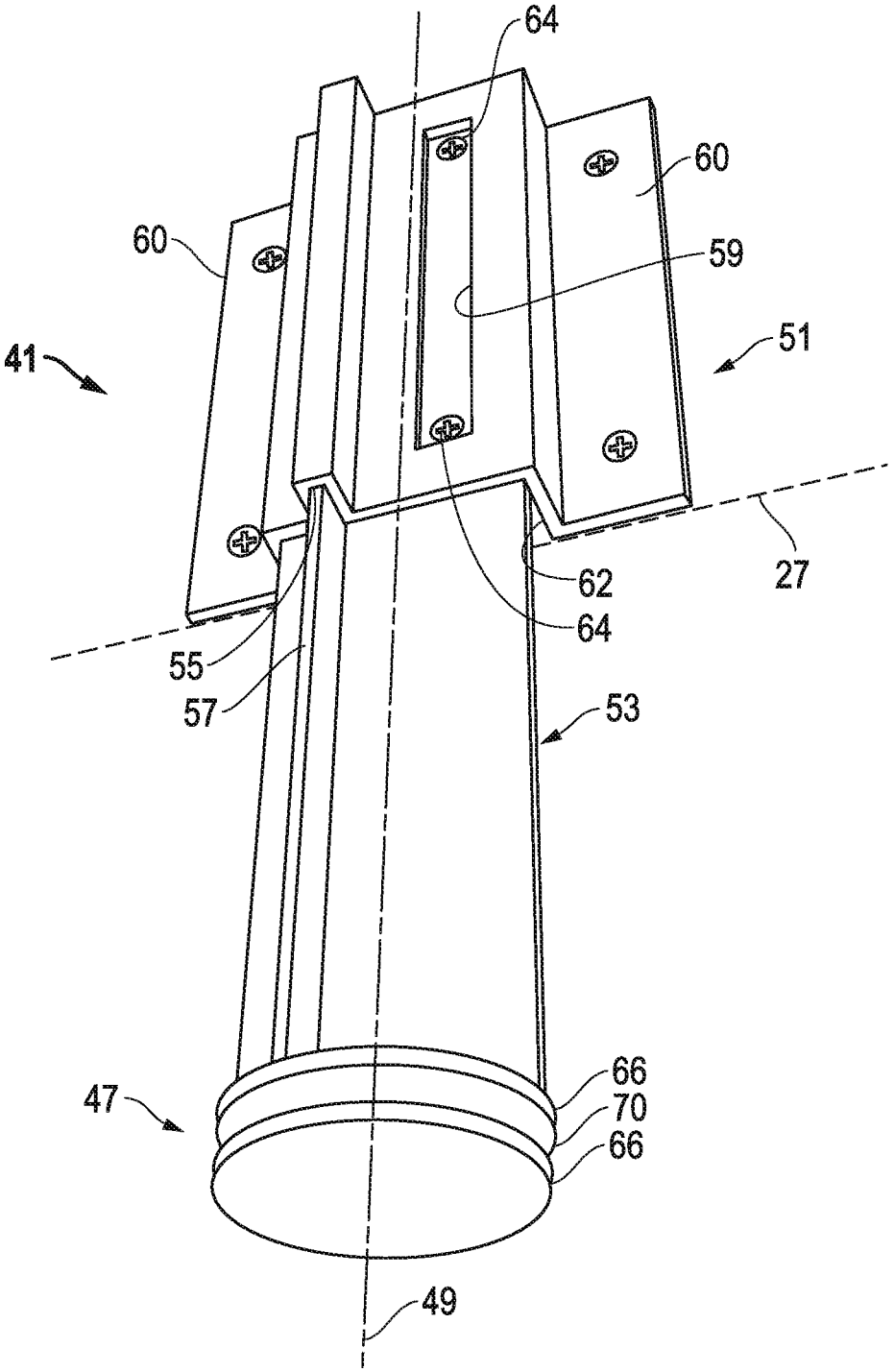
FIG. 12 is a bottom isometric view of the hanger of FIG. 11.

As shown in FIGS. 11 and 12, embodiments of the groove 55 may include two grooves 55, and the rib 57 may include two ribs 57. In some versions, the hanger 41 may have an axial sectional profile of a cross, as illustrated. In one example, an entire axial length of the bracket or first component 51 may comprise the cross, and the strut or second component 53 may comprise the cross for an entire axial length thereof, other than the distal end 47. The slot 59 of the bracket or first component 51 may extend through a longest portion of the cross, as shown.

In some embodiments, the bracket or first component 51 may include two flanges 60 that flushly engage the rafter 27. A pocket 62 may be located between the two flanges 60. Versions of the pocket 62 may form a space between the rafter 27 and the bracket. In addition, the space may be located between the cross and the rafter 27. In another example, the strut or second component 53 may be mounted to the rafter 27 with one or more fasteners 64. The fastener 64 may be configured to extend from the strut and through the space to the rafter 27.

One version of the distal end 47 may include two walls 66 that are substantially perpendicular to the axis 49. The walls 66 may be axially spaced apart from each other to define a recess 70 therebetween. A clip 65 (FIGS. 1A and 1B) may be configured to seat in the recess 70. In another version, the walls 66 may comprise round disks.

Figure 2:
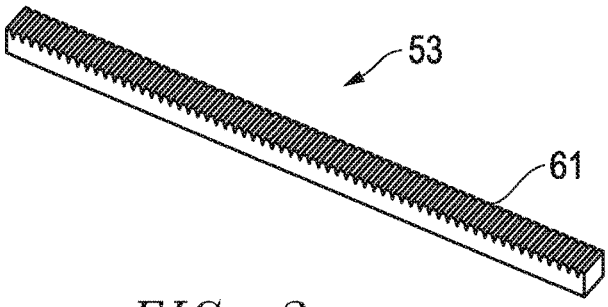
FIG. 2 is an isometric view of embodiments of hardware for the attic insulation system.
Figure 2:
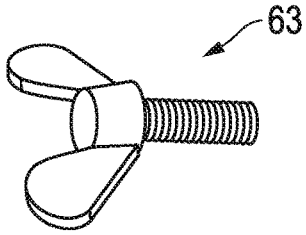

As shown in FIG. 2, one embodiment of the strut or second component 53 may include teeth 61. The teeth 61 may extend along at least a portion of the strut in the axial direction. In addition, the teeth 61 may be movably engaged by a catch (not shown) on the bracket or first component 51. In some versions, the strut or second component 53 may be movable only into the bracket or first component 51, such that no fasteners are required to secure the strut in the assembly. In another example, the catch of the first component 51 may be required to be manually released (e.g., by a user with a screwdriver) to move the strut or second component 53 away from the bracket or first component 51.

In still another example, the strut or second component 53 may be movable into and out of the bracket or first component 51. In such cases, the system may further include a fastener 63, such as a bolt or wing screw, to releasably secure the strut to the bracket.

Embodiments of the barrier 31 (FIGS. 1A and 1B) may comprise a clip 65 mounted to the distal end 47 of the hanger 41. Versions of the clip 65 may include an elongated, substantially flat component that wraps around and engages opposite sides of the distal end 47 of the hanger 41. In some example, the distal end 47 of the hanger 41 is round, and substantially perpendicular to the strut or second component 53. The clip 65 may be used to couple portions of the barrier 31 (e.g., FIG. 1B) to the hanger 41.

In addition, the barrier 31 may include at least one insulation support member 67, 69 (e.g., two shown) coupled to the clip 65 and the distal end 47 of the hanger 41. For example, a first insulation support member 67 may include a substantially planar, elongated panel. The substantially planar, elongated panel or first insulation support member 67 may be directly fastened to the clip 65. In addition, the second insulation support member 69 may be directly fastened to the first insulation support member 67, which may be substantially perpendicular to each other. In one version, the second insulation support member 69 may include a reinforcement rib 68.

Figure 3:
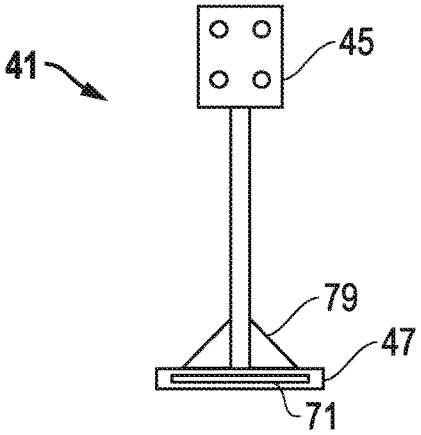
FIG. 3 is a side view of an embodiment of a hanger.
Figure 4A:
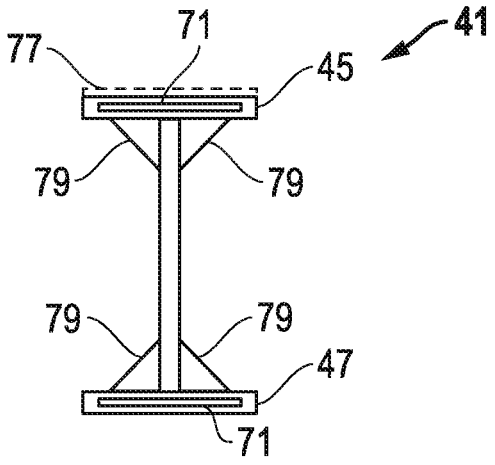
FIGS. 4A and 4B are side and top views, respectively, of another embodiment of a hanger.
Figure 4B:
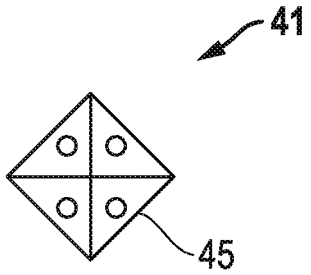

Referring now to FIGS. 3 and 4, embodiments of the hanger 41 may include a plate 71, such as a metal plate, may be located inside one or both of the proximal end 45 and the distal end 47. In one example, the proximal end 45 may include a substantially flat head fastened to a side of the rafter 27 that is substantially perpendicular to the roof deck 25. The hanger 41 also may include a compressible foam 77 (FIG. 4A) located between the proximal end 45 and the rafter 27 to elastify a junction therebetween and improve acoustic insulation thereof. In still another embodiment, the barrier 31 may be secured to the hanger 41 with a magnet (not shown).

Embodiments of the hanger 41 may include one (FIG. 3) or both (FIG. 4) of the proximal end 45 and the distal end 47 comprising a flange that is substantially parallel to the roof deck 25. Such flanges may be integrally formed with the hanger 41, such that the flanges do not comprise separate components that are attached to the hanger 41. In addition, the hanger 41 may include reinforcement wings 79 extending between the shaft of the hanger 41 and the flange(s).

Figure 5A:
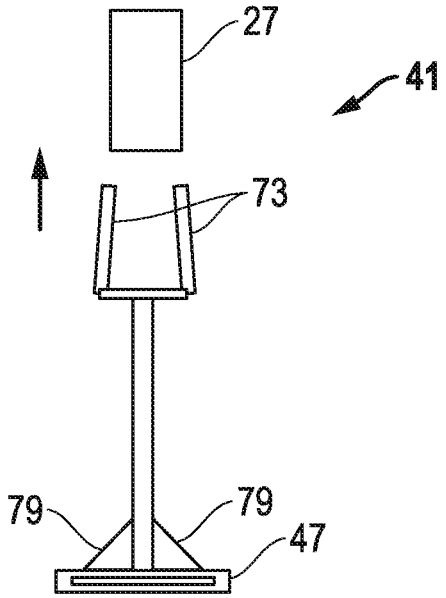
FIGS. 5A and 5B are side views of an embodiment of a hanger before and after installation, respectively.
Figure 5B:
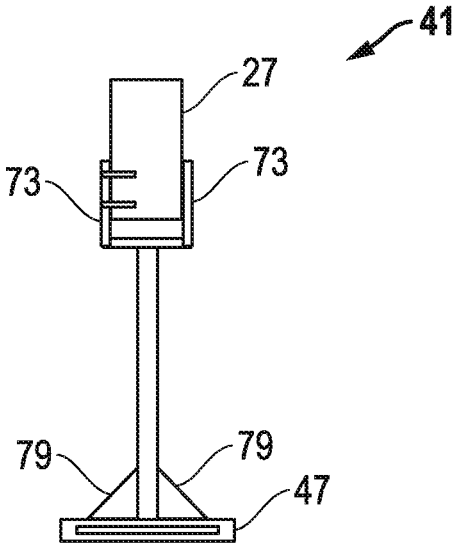

FIG. 5 depicts a version of the hanger 41 wherein the proximal end 45 includes spring clamps 73 that are spring-biased to grip the rafter 27. The spring clamps 73 may have a default or uninstalled configuration (FIG. 5A) wherein a space between them is smaller than a width of rafter 27. In addition, the spring clamps 73 may include an installed configuration (FIG. 5B), wherein they are flexed apart to accommodate the width of the rafter 27, before being secured thereto with fasteners.

Figure 6:
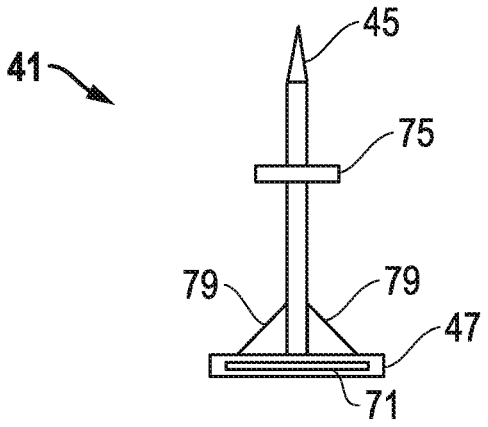
FIG. 6 is a side view of yet another embodiment of a hanger.

In FIG. 6, a stop 75 is shown on the shaft of the hanger 41. In some versions, the stop 75 may be movable relative to the hanger 41 to set a depth of the insulation space. Alternatively, the stop 75 may be integrally molded with and substantially perpendicular to the hanger 41. The hanger 41 may be driven or screwed into the rafter 27 until the stop 75 makes contact with the rafter 27.

Figure 7:
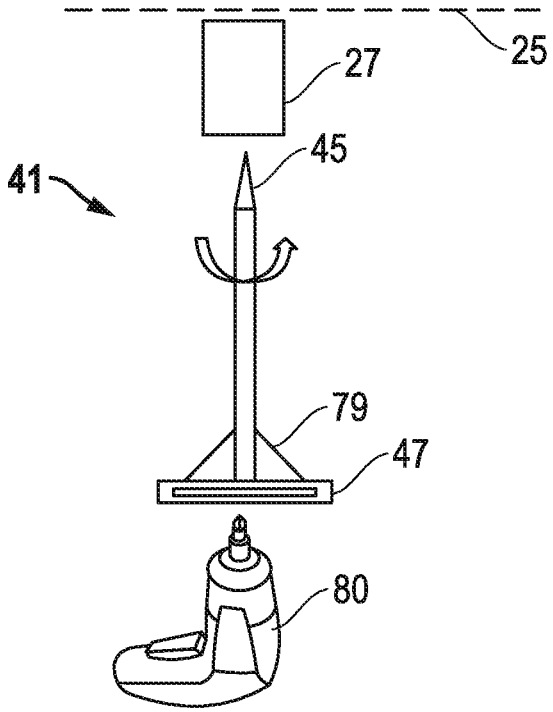
FIG. 7 is a side view of an alternate embodiment of a hanger.

Embodiments of the proximal end 45 may include a pointed screw (FIG. 7) that is screwed directly into a distal end of the rafter 27. The distal end of the rafter 27 may be substantially parallel to the roof deck 25. In one example, the distal end 47 of hanger 41 may include a socket (not shown) configured to be engaged and driven by a screwdriver 80. This embodiment also may employ a stop, as described herein.

Figure 8:
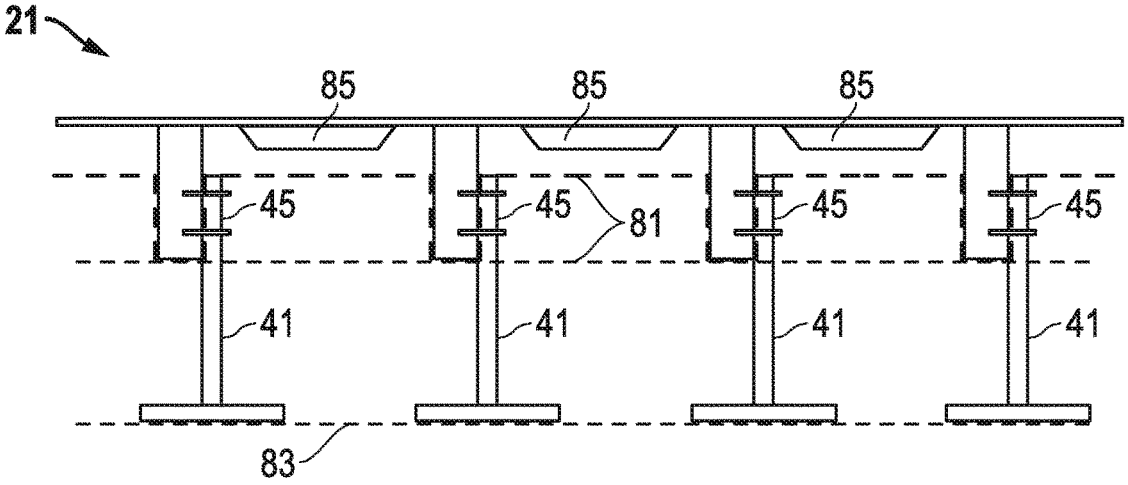
FIG. 8 is a partially sectioned side view of another embodiment of an attic insulation system.

Embodiments of the attic insulation system 21 may enable the hanger 41 to support one or more breathable house wraps 81 (FIG. 8) adjacent the proximal end 45. In addition, a fabric 83 may be positioned adjacent the distal end 47, with or without the use of baffles 85.

Figure 9:
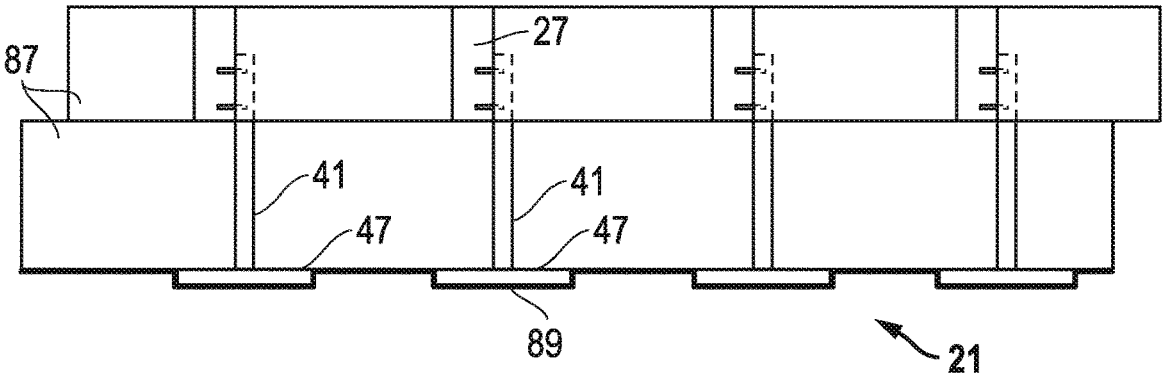
FIG. 9 is a partially sectioned side view of an alternate embodiment of an attic insulation system.

As shown in FIG. 9, the attic insulation system 21 may include insulation comprising kraft-faced batts 87 of insulation. In some embodiments, the distal ends 47 of the hangers 41 may be closed by at least one of bonded, taped or stapled to the kraft-faced batts 87. For example, a tape 89 with a releasable liner may be positioned on one or both of the proximal end 45 and the distal end 47. In one version, the tape 89 may be butyl tape. Such closures may enhance airtightness and moisture management, and avoid sagging thereof. Sagging could generate holes in the system and thermal bridges between the two insulation layers, resulting in potentially unwanted air flows.

Figure 10:
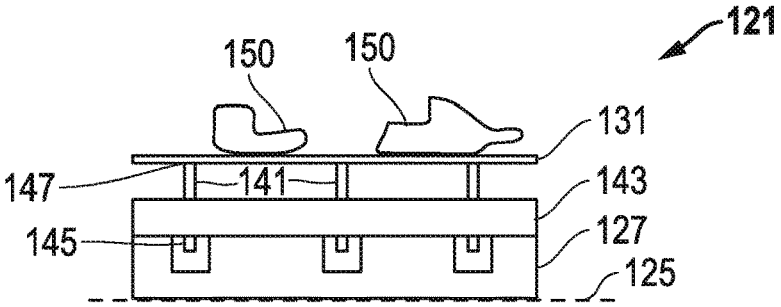
FIG. 10 is a partially sectioned side view of still another embodiment of an attic insulation system.

Embodiments of the attic insulation system 21 may be altered or adapted for other parts of the attic. For example, the attic insulation system 21 also may be configured for use on vertical walls or horizontal floors in the attic. As shown in FIG. 10, an attic insulation system 121 for a home may include an attic with a deck 125, and beams 127 fastened to the deck 125. The deck 125 may be an attic floor deck, a vertical wall deck or a roof deck. The beams 127 may be floor joists, vertical wall beams or roof rafters.

Embodiments of the attic insulation system 121 may include a barrier 131, and supports 141 for providing an insulation space in the attic. Each of the supports 141 may include a support body having a shaft with a proximal end 145 coupled to one of the beams 127, and a distal end 147 coupled to the barrier 131. In some examples, the support 141 may include at least two components, as described elsewhere herein, that are configured to be axially movable relative to each other and assembled together to form the support 141. An insulation space may be defined between the proximal and distal ends 145, 147 of the support 141 inside the barrier 131 to at least partially contain the insulation 143. The supports 141 can be load bearing, such that the attic insulation system 121 can support and store objects 150 on top of the barrier 131. Any component, or combination of components of the attic insulation system 21 (including the barrier 31, hanger 41, insulation 87, rafter 27, stop 75, tape 89, insulation support member 67, house wrap 81, baffle 85, fabric 83, any combination thereof, or other component) may be fire class A (ASTM E84 classification). Fire retardant agents may be added to any component of the attic insulation system 21. In an embodiment, the attic insulation system 21 has a fire class A rating. In another embodiment, the barrier 31, hanger 41, insulation 87, rafter 27, stop 75, tape 89, insulation support member 67, house wrap 81, baffle 85, fabric 83, any combination thereof has a fire class A rating.

Still other embodiments may include one or more of the following embodiments.

Embodiment 1

A hanger for supporting insulation in an attic having a roof deck, and a rafter supporting the roof deck, the hanger comprising:

an axis, a proximal end configured to be coupled to the rafter, a distal end configured to be coupled to a barrier, an insulation space is configured to be defined between the proximal and distal ends, and the hanger comprises at least two components that are configured to be axially movable relative to each other to selectively adjust a depth of the insulation space.

Embodiment 2

The hanger of embodiment 1, wherein the at least two components comprise a first component configured to be mounted to the rafter, a second component configured to engage the first component, and the second component is located inside the barrier.

Embodiment 3

The hanger of embodiment 2, wherein the first component comprises a bracket, the second component comprises a strut that is configured to slidably engage the bracket, and the strut and the bracket are configured to have a slight interference fit, such that the strut is configured to not disengage the bracket due to gravity, and the strut is configured to still be readily movable in the bracket by a user.

Embodiment 4

The hanger of embodiment 3, wherein the bracket has a groove, the strut has a rib that is configured to seat and slide in the groove.

Embodiment 5

The hanger of embodiment 3, wherein the bracket has a slot, and the strut is configured to be fastened directly to the rafter through the slot in the bracket.

Embodiment 6

The hanger of embodiment 3, wherein the strut comprises teeth extending along at least a portion thereof in the axial direction, and the teeth are configured to be movably engaged by a catch on the bracket.

Embodiment 7

The hanger of embodiment 6, wherein the strut is configured to be movable only into the bracket, such that no fasteners are required to secure the strut in an assembly, and the catch must be manually released to move the strut out of the bracket.

Embodiment 8

The hanger of embodiment 6, wherein the strut is configured to be movable into and out of the bracket, and the strut is configured to be secured with a fastener.

Embodiment 9

The hanger of embodiment 8, wherein the fastener comprises a bolt or wing screw.

Embodiment 10

The hanger of embodiment 1, further comprising a clip configured to be mounted to the distal end, and the clip comprises an elongated, substantially flat component that is configured to wrap around and engage opposite sides of the distal end.

Embodiment 11

The hanger of embodiment 10, wherein the distal end is round, and the clip is configured to couple the barrier to the hanger.

Embodiment 12

The hanger of embodiment 10, further comprising at least one insulation support member configured to be coupled to the clip and the distal end.

Embodiment 13

The hanger of embodiment 12, wherein the at least one insulation support member comprises a substantially planar, elongated panel.

Embodiment 14

The hanger of embodiment 13, wherein the substantially planar, elongated panel comprises a first panel directly fastened to the clip, and a second panel directly fastened to the first panel, the second panel is configured to be substantially perpendicular to the first panel, and the second panel comprises a reinforcement rib.

Embodiment 15

The hanger of embodiment 1, wherein a metal plate is located inside at least one of the proximal end or the distal end.

Embodiment 16

The hanger of embodiment 1, wherein the proximal end comprises spring clamps configured to grip the rafter, the spring clamps are configured to have an uninstalled position wherein a space between them is smaller than a width of the rafter, and an installed position wherein they are flexed apart to accommodate a width of the rafter before being secured thereto.

Embodiment 17

The hanger of embodiment 1, further comprising a stop on the hanger, and the stop is movable relative to the hanger to set a depth of the insulation space.

Embodiment 18

The hanger of embodiment 1, further comprising a compressible foam configured to be located between the proximal end and the rafter to elastify a junction therebetween and improve acoustic insulation thereof.

Embodiment 19

The hanger of embodiment 1, wherein the barrier is configured to be secured to the hanger with a magnet.

Embodiment 20

The hanger of embodiment 1, wherein the proximal end comprises a pointed screw configured to be screwed directly into a distal end of the rafter, and the distal end of the rafter is substantially parallel to the roof deck.

Embodiment 21

The hanger of embodiment 20, wherein the distal end comprises a socket configured to be engaged and driven by a screwdriver.

Embodiment 22

The hanger of embodiment 1, wherein at least one of the proximal end or the distal end comprises a flange that is configured to be substantially parallel to the roof deck, and the flange is integrally formed with the hanger such that it does not comprise a separate component that is attached to the hanger.

Embodiment 23

The hanger of Embodiment 22, further comprising reinforcement wings extending between a portion of the hanger and the flange.

Embodiment 24

The hanger of embodiment 1, wherein the hanger is configured to support a breathable housewrap adjacent the proximal end, and a fabric adjacent the distal end, without the use of baffles.

Embodiment 25

The hanger of embodiment 1, wherein the insulation is configured to comprise a kraft-faced batt of insulation, and the distal end is configured to be at least one of bonded, taped or stapled thereto to enhance airtightness and moisture management, and to avoid sagging thereof.

Embodiment 26

The hanger of embodiment 1, further comprising a tape with a releasable liner on at least one of the proximal end and the distal end.

Embodiment 27

The hanger of embodiment 26, wherein the tape comprises butyl tape.

Embodiment 28

The hanger of embodiment 1, wherein the proximal end comprises a head configured to be fastened to a side of the rafter that is substantially perpendicular to the roof deck.

Embodiment 29

The hanger of embodiment 1, wherein the barrier is configured to comprise at least one of a stud, batten, strapping, gypsum board or membrane.

Embodiment 30

The hanger of embodiment 29, wherein the barrier is configured to comprise wood or plastic.

Embodiment 31

The hanger of embodiment 1, wherein the barrier is configured to comprise at least one of an open glass mesh, vapor closed polyethylene or smart vapor retarder (SVR); and the barrier is configured to support blown insulation comprising at least one of fiberglass, stonewool or cellulose.

Embodiment 32

The hanger of embodiment 31, wherein the barrier is configured to be reinforced with a glass net to support a pressure of blown insulation.

Embodiment 33

The hanger of embodiment 31, wherein the barrier is configured to comprise a gypsum board mounted to the distal end, and the SVR is configured to be mounted to the gypsum board.

Embodiment 34

The hanger of embodiment 1, wherein the hanger comprises plastic, and the hanger has a ruler configured to facilitate measurement and adjustment of the hanger relative to the rafter.

Embodiment 35

The hanger of embodiment 1, wherein the hanger comprises polymethyl methacrylate (PMMA) reinforced with glass fibers.

Embodiment 36

The hanger of embodiment 1, wherein the hanger itself is not metallic, the hanger does not form a thermal bridge, and the hanger has a maximum thermal conductivity of 0.5 W/m·K.

Embodiment 37

The hanger of embodiment 1, wherein the hanger also is configured to be used on vertical attic walls or attic floors.

Embodiment 38

The hanger of embodiment 1, wherein the hanger is not designed to be deformable.

Embodiment 39

An attic insulation system for a home having a roof with a roof deck, an attic beneath the roof deck, rafters supporting the roof deck inside the attic, and exterior roofing products mounted to the roof deck opposite the rafters, the attic insulation system comprising:

a barrier;

hangers for supporting insulation in the attic, each of the hangers comprising:

an axis, a proximal end coupled to one of the rafters, and a distal end coupled to the barrier;

a metal plate is located inside at least one of the proximal end or the distal end; and an insulation space is defined between the proximal and distal ends, and the insulation space at least partially contains the insulation.

Embodiment 40

The attic insulation system of embodiment 39, wherein the hanger comprises at least two components that are assembled together to form the hanger.

Embodiment 41

The attic insulation system of embodiment 39, wherein the at least two components are axially movable relative to each other to selectively adjust a depth of the insulation space.

Embodiment 42

The attic insulation system of embodiment 39, wherein the at least two components of the hanger comprise a first component mounted to the rafter, a second component engaged with the first component, and the second component is located inside the barrier.

Embodiment 43

The attic insulation system of embodiment 42, wherein the first component comprises a bracket, and the second component comprises a strut that slidably engages the bracket.

Embodiment 44

The attic insulation system of embodiment 43, wherein the bracket has a groove, and the strut has a rib that seats and slides in the groove.

Embodiment 45

The attic insulation system of embodiment 43, wherein the bracket has a slot, and the strut is fastened directly to the rafter through the slot in the bracket.

Embodiment 46

The attic insulation system of embodiment 43, wherein the strut comprises teeth extending along at least a portion thereof in the axial direction, and the teeth are movably engaged by a catch on the bracket.

Embodiment 47

The attic insulation system of embodiment 46, wherein the strut is movable only into the bracket, such that no fasteners are required to secure the strut, and the catch must be manually released to move the strut out of the bracket.

Embodiment 48

The attic insulation system of embodiment 43, wherein the strut is movable into and out of the bracket, and further comprising a fastener to releasably secure the strut to the bracket.

Embodiment 49

The attic insulation system of embodiment 48, wherein the fastener comprises a bolt or wing screw.

Embodiment 50

The attic insulation system of embodiment 39, further comprising a clip mounted to the distal end, and the clip comprises an elongated, substantially flat component and wraps around and engages opposite sides of the distal end.

Embodiment 51

The attic insulation system of embodiment 50, wherein the distal end is round, and the clip couples the barrier to the hanger.

Embodiment 52

The attic insulation system of embodiment 50, further comprising at least one insulation support member coupled to the clip and the distal end.

Embodiment 53

The attic insulation system of embodiment 52, wherein the at least one insulation support member comprises a substantially planar, elongated panel.

Embodiment 54

The attic insulation system of embodiment 53, wherein the substantially planar, elongated panel comprises a first panel directly fastened to the clip, and a second panel directly fastened to the first panel, the second panel is substantially perpendicular to the first panel, and the second panel comprises a reinforcement rib.

Embodiment 55

The attic insulation system of embodiment 43, wherein the strut and the bracket have a slight interference fit, such that the strut does not disengage the bracket due to gravity, and the strut is still readily movable by a user.

Embodiment 56

The attic insulation system of embodiment 39, wherein the proximal end comprises spring clamps that grip the rafter, the spring clamps have an uninstalled position wherein a space between them is smaller than a width of the rafter, and an installed position wherein they are flexed apart to accommodate a width of the rafter before being secured thereto.

Embodiment 57

The attic insulation system of embodiment 39, further comprising a stop on the hanger, and the stop is movable relative to the hanger to set a depth of the insulation space.

Embodiment 58

The attic insulation system of embodiment 39, wherein the hanger comprises plastic, and a ruler to facilitate measurement and adjustment of the hanger relative to the rafter.

Embodiment 59

The attic insulation system of embodiment 39, wherein the hanger itself is not metallic, no portion of the attic insulation system forms a thermal bridge, and the hanger has a maximum thermal conductivity of 0.5 W/m·K.

Embodiment 60

The attic insulation system of embodiment 39, further comprising a compressible foam located between the proximal end and the rafter to elastify a junction therebetween and improve acoustic insulation thereof.

Embodiment 61

The attic insulation system of embodiment 39, wherein the barrier is secured to the hanger with a magnet.

Embodiment 62

The attic insulation system of embodiment 39, wherein the proximal end comprises a pointed screw that is screwed directly into a distal end of the rafter, and the distal end of the rafter is substantially parallel to the roof deck.

Embodiment 63

The attic insulation system of embodiment 62, wherein the distal end comprises a socket configured to be engaged and driven by a screwdriver.

Embodiment 64

The attic insulation system of embodiment 39, wherein at least one of the proximal end or the distal end comprises a flange that is substantially parallel to the roof deck, and the flange is integrally formed with the hanger such that it does not comprise a separate component that is attached to the hanger.

Embodiment 65

The attic insulation system of embodiment 64, further comprising reinforcement wings extending between a portion of the hanger and the flange.

Embodiment 66

The attic insulation system of embodiment 39, wherein the hanger supports a breathable house wrap adjacent the proximal end, and a fabric adjacent the distal end, without the use of baffles.

Embodiment 67

The attic insulation system of embodiment 39, wherein the insulation comprises a kraft-faced batt of insulation, and the distal end is at least one of bonded, taped or stapled thereto to enhance airtightness and moisture management, and to avoid sagging thereof.

Embodiment 68

The attic insulation system of embodiment 39, further comprising a tape with a releasable liner on at least one of the proximal end and the distal end.

Embodiment 69

The attic insulation system of embodiment 68, wherein the tape comprises butyl tape.

Embodiment 70

The attic insulation system of embodiment 39, wherein the proximal end comprises a head configured to be fastened to a side of the rafter that is substantially perpendicular to the roof deck.

Embodiment 71

The attic insulation system of embodiment 39, wherein the barrier comprises at least one of a stud, batten, strapping, gypsum board or membrane.

Embodiment 72

The attic insulation system of embodiment 71, wherein the barrier comprises wood or plastic.

Embodiment 73

The attic insulation system of embodiment 39, wherein the barrier comprises at least one of an open glass mesh, vapor closed polyethylene or smart vapor retarder (SVR); and the barrier supports blown insulation comprising at least one of fiberglass, stonewool or cellulose.

Embodiment 74

The attic insulation system of embodiment 73, wherein the barrier is reinforced with a glass net that supports a pressure of blown insulation.

Embodiment 75

The attic insulation system of embodiment 73, wherein the barrier comprises a gypsum board mounted to the distal end, and the SVR is mounted to the gypsum board.

Embodiment 76

The attic insulation system of embodiment 39, wherein the hanger comprises plastic.

Embodiment 77

The attic insulation system of embodiment 39, wherein the hanger comprises polymethyl methacrylate (PMMA) reinforced with glass fibers.

Embodiment 78

The attic insulation system of embodiment 39, wherein the hanger itself is not metallic.

Embodiment 79

The attic insulation system of embodiment 39, wherein the attic insulation system also is used on at least one of attic walls or attic floors Embodiment 80

The attic insulation system of embodiment 39, wherein the hanger is not designed to be deformable.

Embodiment 81

An attic insulation system for a home having an attic with a deck, beams fastened to the deck, the attic insulation system comprising:

a barrier;

supports for providing an insulation space in the attic, each of the supports comprising:

an axis, a proximal end coupled to one of the beams, a distal end coupled to the barrier, and the support comprises at least two components that are axially movable relative to each other to adjust a depth of the insulation space; and the insulation space is defined between the proximal and distal ends, and the insulation space at least partially contains insulation.

Embodiment 82

The attic insulation system of embodiment 81, wherein the deck is an attic floor deck and the beams are floor joists.

Embodiment 83

The attic insulation system of embodiment 81, wherein the deck is an attic side wall panel and the beams are side wall beams.

Embodiment 84

The attic insulation system of embodiment 81, wherein the deck is a roof deck and the beams are roof rafters.

Embodiment 85

The attic insulation system of embodiment 81, wherein the supports are load bearing, such that the attic insulation system supports and stores objects on top of the barrier or attached to the barrier.

Embodiment 86

The hanger of embodiment 4, wherein the groove comprises two grooves, the rib comprises two ribs, and the hanger comprises an axial sectional profile of a cross.

Embodiment 87

The hanger of embodiment 86, wherein an entire axial length of the bracket comprises the cross, and the strut comprises the cross for an entire axial length thereof, other than the distal end.

Embodiment 88

The hanger of embodiment 87, wherein the bracket comprises two flanges configured to flushly engage the rafter, a pocket located between the two flanges, the pocket is configured to form a space between the rafter and the bracket, and the space is configured to be located between the cross and the rafter.

Embodiment 89

The hanger of embodiment 88, wherein the strut is configured to be mounted to the rafter with a fastener, and the fastener is configured to extend from the strut and through the space to the rafter.

Embodiment 90

The hanger of embodiment 10, wherein the distal end comprises two walls that are substantially perpendicular to the axis, the walls are axially spaced apart from each other to define a recess therebetween, and the clip is configured to seat in the recess.

Embodiment 91

The hanger of embodiment 90, wherein the walls comprise round disks.

Embodiment 92

An attic insulation system for a home having a roof with a roof deck, an attic beneath the roof deck, rafters supporting the roof deck inside the attic, and exterior roofing products mounted to the roof deck opposite the rafters, the attic insulation system comprising:

a barrier;

hangers for supporting insulation in the attic, each of the hangers comprising:

an axis, a proximal end coupled to one of the rafters, and a distal end coupled to the barrier; and an insulation space is defined between the proximal and distal ends, and the insulation space at least partially contains the insulation, wherein the distal end is configured to be at least one of bonded, taped or stapled thereto to enhance airtightness and moisture management, and to avoid sagging thereof.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A hanger for supporting insulation in an attic having a roof deck, and a rafter supporting the roof deck, the hanger comprising:

an axis, a proximal end configured to be coupled to the rafter, a distal end configured to be coupled to a barrier, an insulation space defined between the proximal and distal ends, the hanger comprising a bracket configured to be coupled to a side of the rafter and having a groove extending axially along an entire length of the bracket and further having a slot, and a strut configured to be coupled directly to the rafter at the proximal end through the slot and coupled to the barrier at the distal end and having a rib extending axially along a length of the strut, wherein the rib of the strut seats in and slides axially within the groove of the bracket, such that the bracket and the strut are slidably engaged and axially movable relative to each other to selectively adjust a depth of the insulation space.

2. The hanger of claim 1, wherein each of the bracket and the strut are located inside the barrier.

3. The hanger of claim 1, wherein the bracket has an additional groove, and wherein the strut has an additional rib that is configured to seat and slide in the additional groove.

4. The hanger of claim 1, wherein the strut comprises teeth extending along at least a portion thereof in the axial direction, and the teeth are configured to be movably engaged by a catch on the bracket.

5. The hanger of claim 4, wherein the strut is configured to be movable into and out of the bracket, and the strut is configured to be secured with a fastener.

6. The hanger of claim 1, further comprising: a clip configured to be mounted to the distal end, wherein the clip comprises an elongated, substantially flat component that is configured to wrap around and engage opposite sides of the distal end.

7. The hanger of claim 1, wherein a metal plate is located inside at least one of the proximal end or the distal end.

8. The hanger of claim 1, further comprising a stop on the hanger, and the stop is movable relative to the hanger to set a depth of the insulation space.

9. The hanger of claim 1, wherein at least one of the proximal end or the distal end comprises a flange that is configured to be substantially parallel to the roof deck, and the flange is integrally formed with the hanger such that it does not comprise a separate component that is attached to the hanger.

10. The hanger of claim 1, wherein the proximal end comprises a head configured to be fastened to the side of the rafter that is substantially perpendicular to the roof deck.

* * * * *